US006678490B2

(12) United States Patent
Tanaka

(10) Patent No.: US 6,678,490 B2
(45) Date of Patent: Jan. 13, 2004

(54) RECORDING MEDIUM CONVEYING MECHANISM WITH FIRST AND SECOND ENGAGING PORTIONS DIRECTLY ENGAGED WITH EACH OTHER TO POSITION FIRST AND SECOND ROTARY BODIES AND IMAGE FORMING APPARATUS USING THE SAME

(75) Inventor: Akiyoshi Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 10/006,392

(22) Filed: Dec. 10, 2001

(65) Prior Publication Data

US 2002/0071703 A1 Jun. 13, 2002

(30) Foreign Application Priority Data

Dec. 11, 2000 (JP) ..... 2000-404117

(51) Int. Cl.[7] ..... G03G 15/00; G03G 21/00

(52) U.S. Cl. ..... 399/124; 399/125

(58) Field of Search ..... 399/121, 124, 399/125, 313

(56) References Cited

U.S. PATENT DOCUMENTS

| | | | | |
|---|---|---|---|---|
| 4,696,561 A | | 9/1987 | Katoh et al. | 399/122 |
| 5,572,305 A | * | 11/1996 | Hayashi et al. | 399/121 |
| 5,614,992 A | * | 3/1997 | Kikuchi et al. | 399/124 |
| 5,787,326 A | * | 7/1998 | Ogawa et al. | 399/124 |
| 5,802,426 A | * | 9/1998 | Miyazaki et al. | 399/121 X |
| 6,101,351 A | * | 8/2000 | Suda et al. | 399/125 X |
| 6,144,822 A | * | 11/2000 | Yamaguchi et al. | 399/121 |
| 6,256,472 B1 | * | 7/2001 | Miyake et al. | 399/313 |

FOREIGN PATENT DOCUMENTS

| | | | |
|---|---|---|---|
| JP | 04-7240 | | 1/1992 |
| JP | 6-156798 | | 6/1994 |
| JP | 2000-47444 | | 2/2000 |
| JP | 2000-214718 | | 8/2000 |
| JP | 2000-231321 | * | 8/2000 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

In a recording medium conveying mechanism for an image forming apparatus of the present invention, a first and a second rotary body rotate in contact with each other for conveying a paper sheet to which a toner image is to be transferred. The first and second rotary bodies are respectively mounted on the apparatus body and an openable cover mounted on the apparatus body. The second rotary body moves into or out of contact with the first rotary body in interlocked relation to the closing or the opening, respectively, of the cover. The conveying mechanism includes a first support member rotatably supporting the first rotary body on the apparatus body and including a first engaging portion. A second support member rotatably supports the second rotary body on the cover and includes a second engaging portion. The first and second engaging portions mate with each other when the cover is closed.

5 Claims, 6 Drawing Sheets

RECORDING MEDIUM CONVEYING MECHANISM WITH FIRST AND SECOND ENGAGING PORTIONS DIRECTLY ENGAGED WITH EACH OTHER TO POSITION FIRST AND SECOND ROTARY BODIES AND IMAGE FORMING APPARATUS USING THE SAME

BACKGROUND OF THE INVENTION

1. Field of the Invention

The present invention relates to a mechanism arranged in an image forming apparatus for conveying a paper sheet or similar recording medium and an image forming apparatus using the same.

2. Description of the Background Art

A copier, facsimile apparatus, printer or similar image forming apparatus includes a mechanism for conveying a paper sheet or similar recording medium with a pair of rotary bodies. The rotary bodies rotate in contact with each other to thereby nip the paper sheet therebetween. The paper sheet sometimes jams a sheet path arranged in the mechanism. In light of this, the mechanism should preferably be so arranged as to facilitate the removal of the jamming sheet. There has been proposed an image forming apparatus in which two rotary bodies rotatable in contact with each other are respectively mounted on the apparatus body and an openable cover mounted on the apparatus body. This type of apparatus allows the operator of the apparatus to easily remove a jamming sheet by opening the cover and thereby moving the rotary body mounted thereon away from the other rotary body.

The prerequisite with the two rotary bodies is that their axes of rotation be accurately parallel to each other; otherwise, the mechanism is apt to fail to convey a paper sheet straight and often brings about a jam. However, parallelism between the two rotary bodies is difficult to achieve because not only the position of the rotary body on the cover but also the position of the cover relative to the apparatus body and opening and closing operations thereof need certain accuracy. Moreover, even if parallelism is set up between the rotary bodies, the relative position of the rotary bodies varies when the door becomes unstable due to repeated opening and closing. It is therefore extremely difficult to maintain the rotary bodies parallel over a long period of time.

To prevent the cover from becoming unstable, a mechanism for opening and closing the cover may be formed of a highly rigid material or use may be made of a mechanism for preventing screws from being loosened. This kind of scheme, however, increases the cost of the apparatus.

Technologies relating to the present invention are disclosed in, e.g., Japanese Patent Laid-Open Publication Nos. 6-156798 and 2000-214718.

SUMMARY OF THE INVENTION

It is an objet of the present invention to provide a recording medium conveying mechanism capable of ensuring parallelism between two rotary bodies over a long period of time without resorting to any special measure against the instability of an openable cover, and an image forming apparatus using the same.

In accordance with the present invention, in a recording medium conveying mechanism for an image forming apparatus, a first and a second rotary body rotate in contact with each other for conveying a paper sheet to which a toner image is to be transferred. The first and second rotary bodies are respectively mounted on the apparatus body and an openable cover mounted on the apparatus body. The second rotary body moves into or out of contact with the first rotary body in interlocked relation to the closing or the opening, respectively, of the cover. The conveying mechanism includes a first support member rotatably supporting the first rotary body on the apparatus body and including a first engaging portion. A second support member rotatably supports the second rotary body on the cover and includes a second engaging portion. The first and second engaging portions mate with each other when the cover is closed.

An image forming apparatus including the above mechanism is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
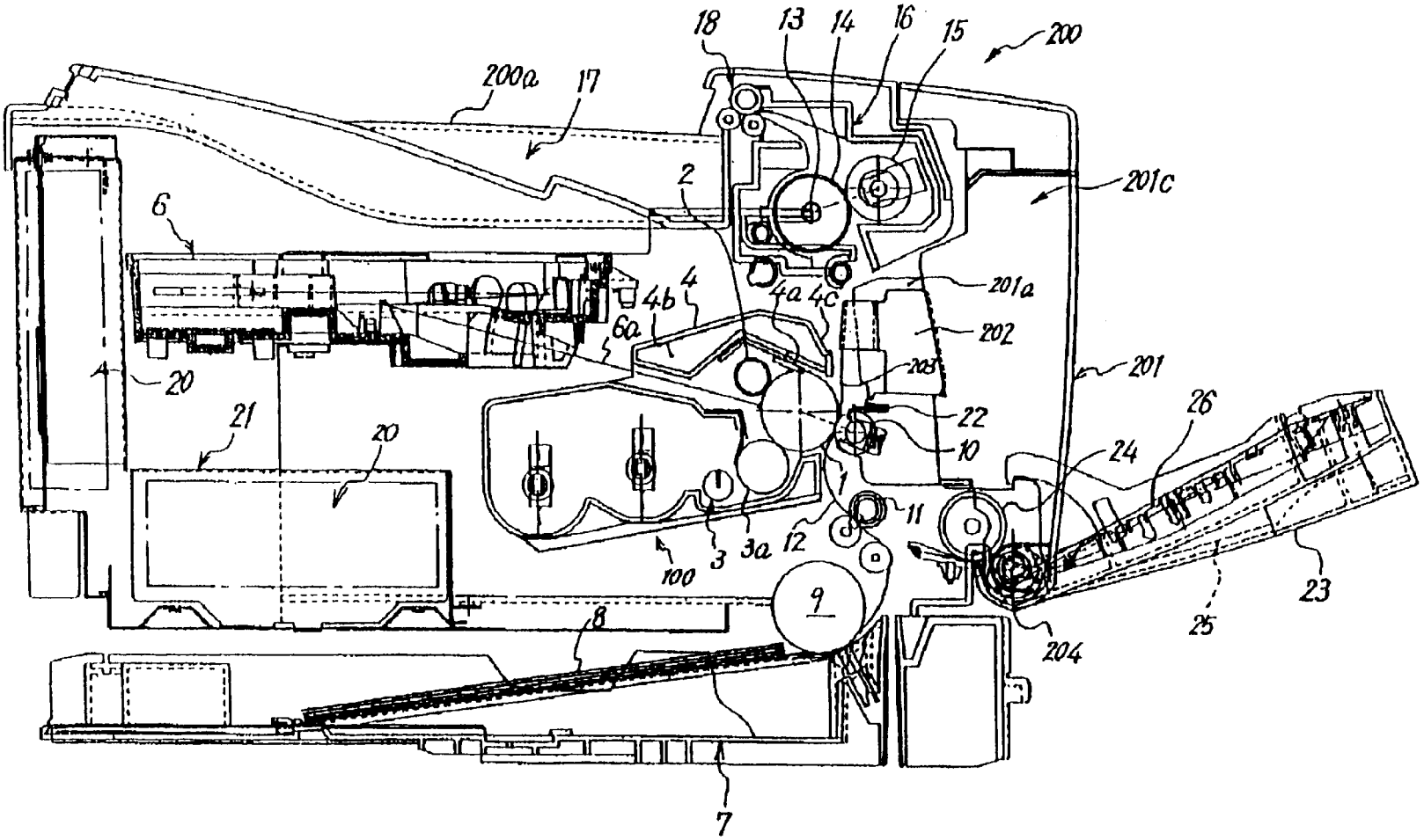
FIG. 1 is a view showing an image forming apparatus embodying the present invention.

Referring to FIG. 1 of the drawings, an image forming apparatus embodying the present invention is shown and implemented as an electrophotographic laser printer by way of example. As shown, the printer, generally 200, includes an image forming unit 100 removably mounted to the printer body. The image forming unit 100 includes a photoconductive drum or image carrier 1, a charge roller 2, a developing unit 3, and a cleaning unit 4 for cleaning the drum 1. In the illustrative embodiment, the drum plays the role of a first rotary body.

An optical writing unit 6 is positioned at one side of the image forming unit 100 for writing a latent image on the drum 1. The writing unit 6 may be of the conventional type using a semiconductor laser as a light source. In this type of writing unit 6, the semiconductor laser emits a laser beam in accordance with image data representative of a document image, which is read by a scanner. The laser beam, labeled 6*a*, is routed through a polygonal mirror, which is in rotation, a lens and a mirror to the drum 1, writing a latent image corresponding to the document image. The developing unit 3 develops the latent image with a toner or developer to thereby produce a corresponding toner image.

A sheet cassette 7 is positioned below the image forming unit 100 and loaded with a stack of paper sheets or recording media 8. A pickup roller 9 pays out the paper sheets 8 from the sheet cassette 7 one by one toward a registration roller 11. The registration roller 11 once stops the paper sheet 8 and then drives it toward a nip between the drum 1 and an image transfer roller 10 such that the leading edge of the paper sheet 8 meets the leading edge of the toner image formed on the drum 1. In the illustrative embodiment, the image transfer roller 10 plays the role of a second rotary body.

A fixing device 16 is positioned above the image forming unit 100 and includes a heat roller 14 and a press roller 15. The heat roller 14 and press roller 15 are pressed against each other at opposite sides of a sheet path 12. The heat roller 14 accommodates a heater 13 therein. An outlet roller 18 is positioned downstream of the fixing device 16 in the direction of sheet conveyance. The top of part of a casing 200*a* forms a stacker portion 17. The outlet roller 18 drives the paper sheet 8 coming out of a nip between the heat roller 14 and the press roller 15 out of the printer body to the stacker portion 17.

A control unit 20 is disposed in the casing 200*a* for controlling various image forming means joining in the image forming process of the printer 200 as well as print data. The control unit 20 includes a control board loaded with various switches and control circuitry although not shown specifically. The control unit 200 is accommodated in a metallic casing 21, which extends downward from one side of the writing unit 6.

In operation, while the drum 1 is in rotation, the charge roller 2 uniformly charges the surface of the drum 1. The writing unit 6 scans the charged surface of the drum 1 with a laser beam in accordance with image data, forming a latent image on the drum 1. The developing unit 3 includes a developing roller 3*a* on which toner or developer is deposited. The toner deposits on the latent image to thereby form a corresponding toner image.

In parallel with the formation of the toner image on the drum 1, the pickup roller 9 pays out one paper sheet 8 from the sheet cassette 7 toward the registration roller 11. The registration roller 11 once stops the paper sheet 8 and then drives it toward the nip between the drum 1 and the image transfer roller 10 (image transfer nip hereinafter) at the previously stated timing. At the above nip, the toner image is transferred from the drum 1 to the paper sheet 8. Subsequently, the paper sheet 8 is brought into contact with a discharge brush 22 and discharged thereby.

A peeler is held in contact with the drum 1 at a position slightly downstream of the image transfer nip in the direction of rotation of the drum 1. The peeler contacts the paper sheet 8 and physically peels it off the drum 1. The paper sheet 8 is then conveyed to the fixing unit 16. In the fixing unit 16, the heat roller 14 and press roller 15 nip the paper sheet 8 therebetween and fixes the toner image on the sheet 8 with heat and pressure. The outlet roller 18 conveys the paper sheet with the fixed toner image to the stacker portion 17.

After the transfer of the toner image from the drum 1 to the paper sheet 8, the cleaning unit 4 removes the toner left on the drum 1 with a blade 4*a*. The toner removed by the blade 4*a* is collected in a case 4*b*.

The casing 200*a* of the printer 200 supports an openable cover 201 and a manual sheet feed unit 23 via a single shaft 204, which is parallel to the axis of the image transfer roller 10. The openable cover 201 forms one side wall of the casing 200*a* adjoining the sheet path 12. The manual sheet feed unit 23 allows the operator of the printer to feed a thick sheet, OHP (OverHead Projector) sheet or similar special sheet by hand. The manual sheet feed unit 23 is rotatable about the shaft 204 between an open position indicated by a solid line in FIG. 1 and a closed position indicated by a phantom line. In the closed position, the manual sheet feed unit 23 is received in a space 201*c* formed in the casing 200*a*. A pickup roller 24 also feeds the sheet from the manual sheet feed unit 23 toward the registration roller 11.

Figure 2:
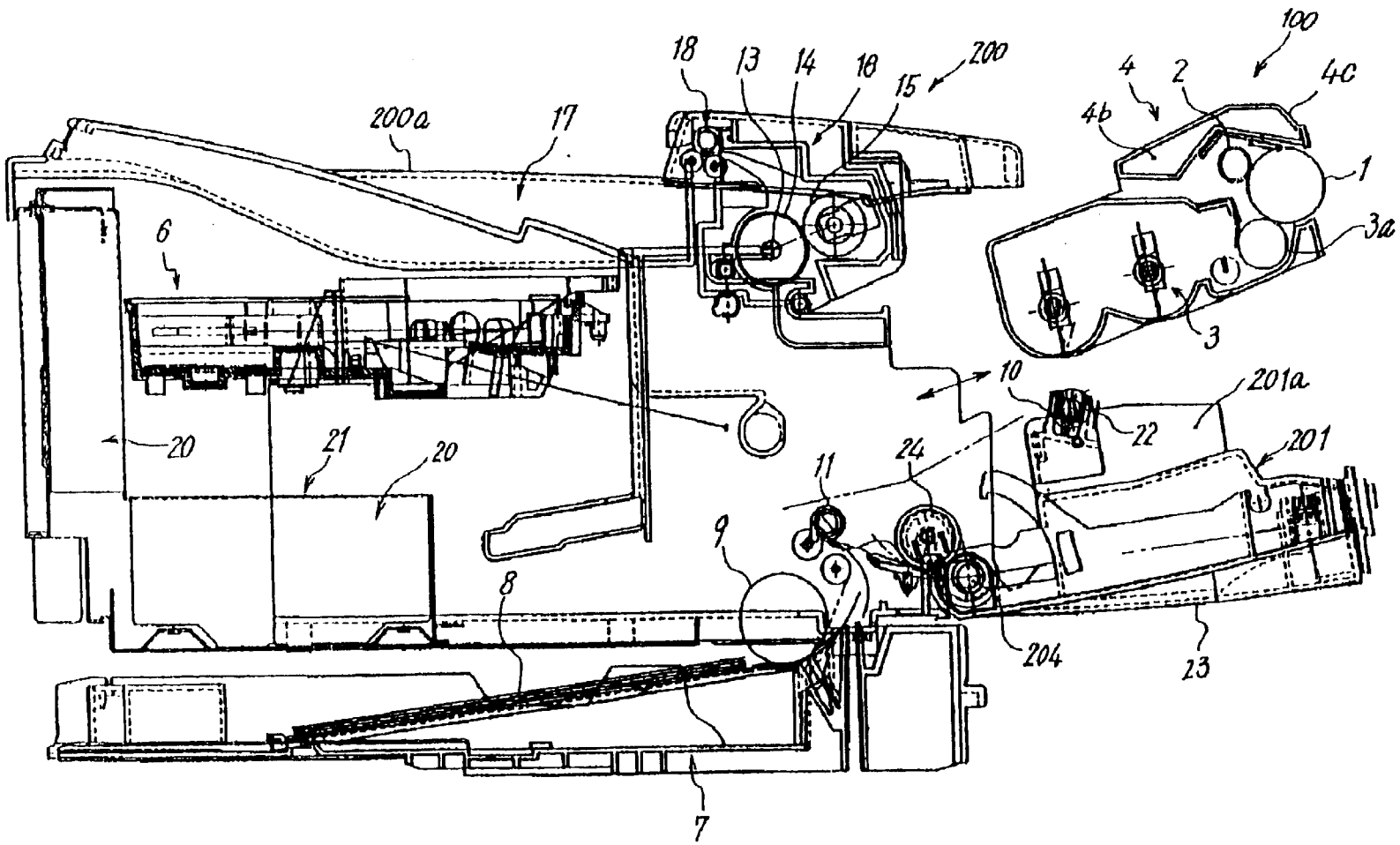
FIG. 2 is a view showing an openable cover included in the illustrative embodiment in an open position.

Assume that the operator opens the cover 201 about the shaft 204 clockwise, as viewed in FIG. 1. Then, as shown in FIG. 2, the image transfer roller 10 and discharge brush 22 and a sheet guide 201*a*, which are mounted on the cover 201, are moved away from the sheet path 12, exposing the sheet path 12 to the outside of the casing 200*a*. In this condition, the operator can easily mount or dismount the image forming unit 100 to or from the casing 200*a*, replace the fixing unit 16 or remove the paper sheet 8 jamming the sheet path 12.

Figure 3:
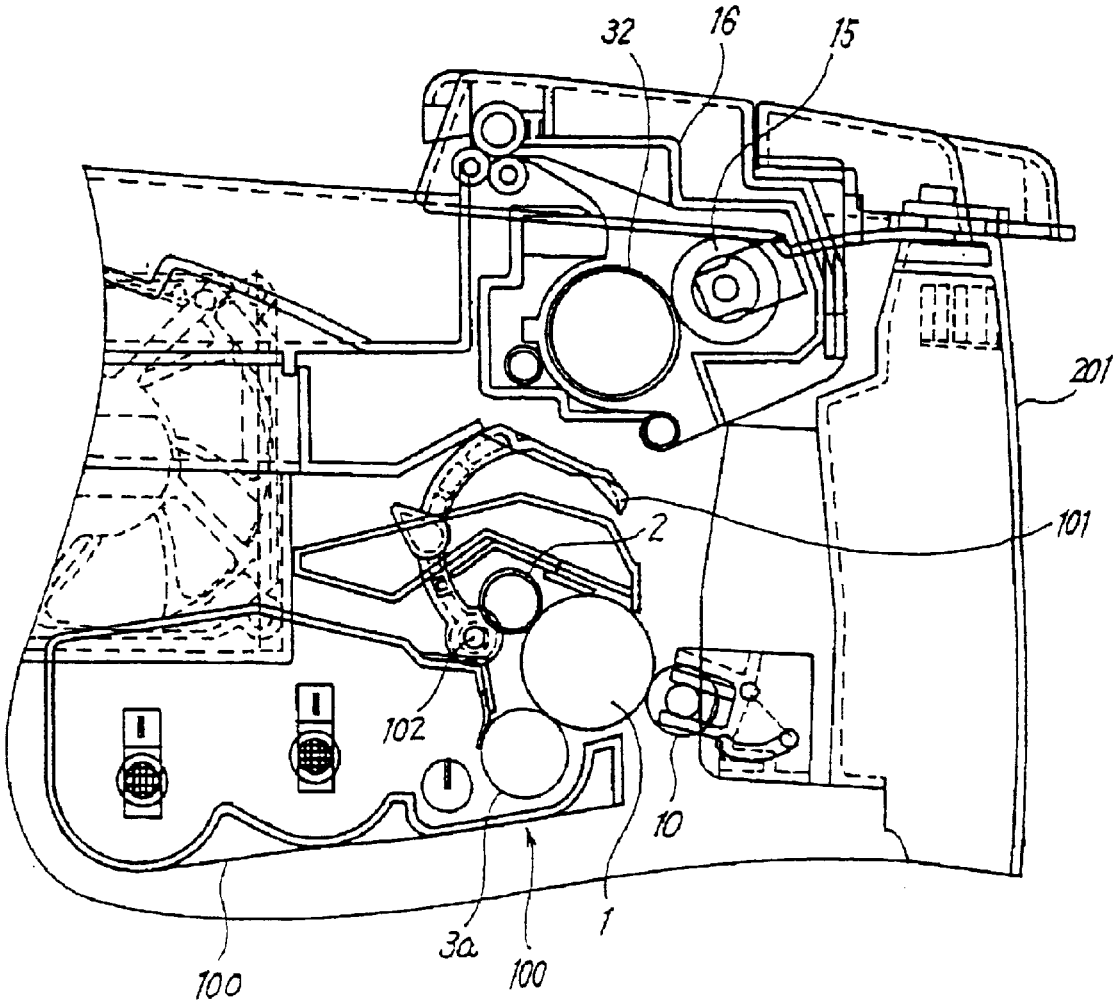
FIG. 3 is a fragmentary enlarged view of an image forming unit included in the illustrative embodiment.
Figure 4:
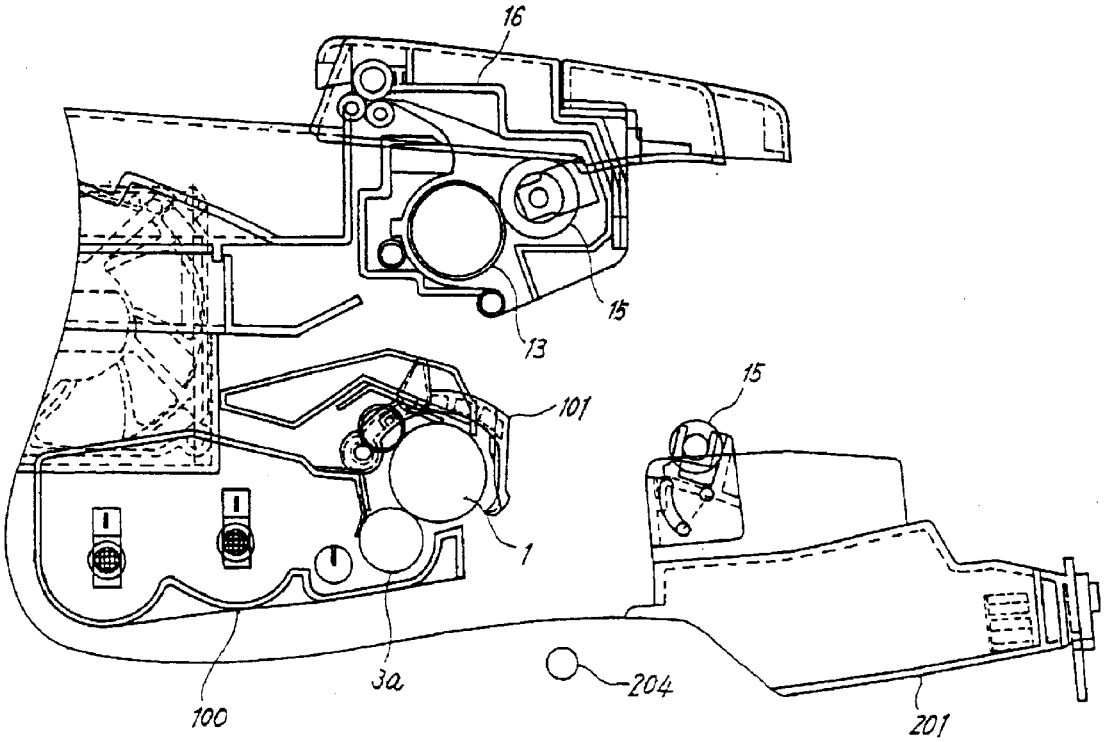
FIG. 4 is a fragmentary enlarged view showing the image forming unit with the cover being opened.

FIG. 3 is an enlarged view showing the image forming unit 100 together with arrangements around the unit 100. As shown, a protection shutter 101 is journalled to opposite side walls of the image forming unit 100 via a shaft 102. When the cover 201 is closed, the protection shutter 101 intervenes between the fixing device 16 and the drum 1 in order to prevent heat from being transferred from the heat roller 14 to the drum 1. As shown in FIG. 4, when the cover 201 is opened about the shaft 204, the protection shutter 101 automatically rotates about the shaft 102 to a position where it conceals the drum 1 from the outside of the image forming unit 100.

Figure 5:
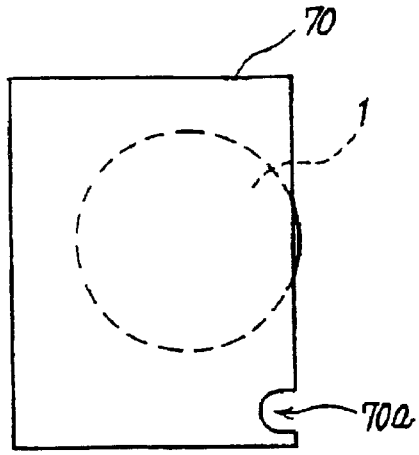
FIG. 5 shows part of a side wall Included in the image forming unit.

Arrangements unique to the illustrative embodiment will be described hereinafter. FIG. 5 shows one side wall 70 of the image forming unit 100. As shown, a notch 70*a* is formed in one side of the side wall 70 and serves as an engaging portion. The side wall 70 not only forms part of the casing of the image forming unit 100, but also plays the role of a first support member for rotatably supporting the drum 1.

Figure 6:
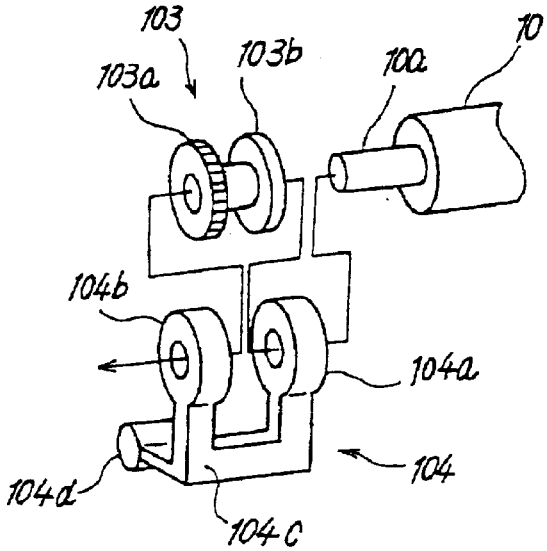
FIG. 6 is an isometric view showing one end portion of an image transfer roller and a support member included in the illustrative embodiment.

FIG. 6 shows one end portion of the image transfer roller 10 and a member supporting it. As shown, a support member or second support member 104 rotatably supports the roller 10 and includes two annular bearing portions 104*a* and 104*b*. More specifically, a shaft 10*a* protruding form the end of the roller 10 is passed through the bearing portions 104*a* and 104*b*, so that the roller 10 is rotatably supported. A gear member 103 is positioned between the bearing portions 104*a* and 104*b* and formed with a through bore. The shaft 10*a* is passed through the bore of the gear member 104 as well, as illustrated. The gear member 103 includes a gear portion 103*a* and a roller portion 103*b* having a greater diameter than the gear portion 103*a*. The gear member 103 is affixed to the shaft 10*a* by a screw or similar fastening means.

A gear is also mounted on each end of the drum 1 although not shown specifically. When this gear is brought into mesh with the gear portion 103*a* of the gear member 103, the rotation of the drum 1 can be transmitted to the image transfer roller 10. When the cover 201 is closed, the roller portion 103*b* of the gear member 103 abuts against the circumference of the drum 1 to thereby limit the bite of the image transfer roller 10 into the drum 1. It is to be noted that the roller portion of the roller 10 is formed of an elastic material, so that it can bite into the drum 1.

Figure 7:
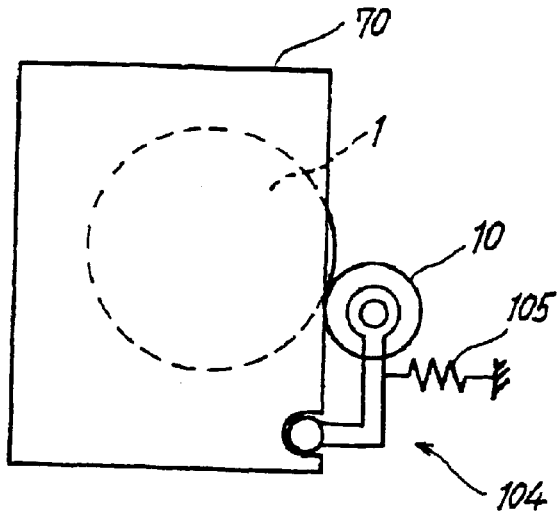
FIG. 7 shows how a recess and a rod portion included in the side wall and support member, respectively, mate with each other.

The support member 104 additionally includes a cylindrical rod portion 104*d* and a tie portion 104*c*. The rod portion 104*d* extends in the axial direction of the shaft 10*a* of the image transfer roller 10. The tie portion 104*c* connects the rod portion 104*d* and two bearing portions 104*a* and 104*b*. As shown in FIG. 7, when the cover 201 is closed, the rod portion, or engaging portion, 104*d* is brought into engagement with the notch 70*a* of the side wall 70 under the action of a spring 105. Therefore, even when the cover 201 becomes unstable due to repeated opening and closing, the rod portion 104*d* and notch 70*a* cooperate to maintain the image transfer roller 10 parallel to the drum 1 over a long period of time. This obviates the need for a special measure against the instability of the cover 201.

The spring 105 biases the image transfer roller 10 against the drum 1. The force of the spring 105 and the arrangement for the spring 105 to bias the support member 104 should preferably be selected in accordance with a force with which the image transfer roller 10 should press the drum 1, a pressure expected to act on the side wall 70, a layout around the support member 104 and so forth.

Assume that the gears of the image transfer roller 10 are brought into mesh with, e.g., flange gears mounted on the drum or that the roller portion of the roller 10 is brought into contact with the drum 1 being rotated. Then, rotation transferred from the drum 1 to the roller 10 causes a force tending to move the roller 10 in a direction indicated by an arrow in FIG. 8 to act on the roller 10. As a result, the roller 10 is apt to move away from a preselected position out of parallelism with respect to the drum 1. In the illustrative embodiment, when the roller 10 tends to move in the direction shown in FIG. 8, the edge of the notch 70*a* of the side wall 70 catches the rod portion 104*d* of the support member 104 and thereby prevents the roller 10 from moving in the above direction. Therefore, parallelism between the drum 1 and the roller 10 is prevented from being disturbed by the instability of the cover 201 or the dislocation of the roller 10.

Figure 8:
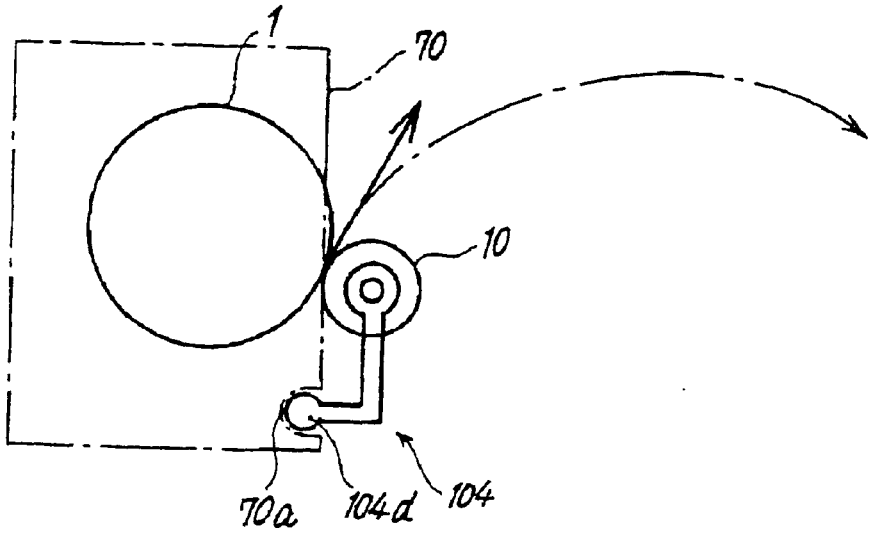
FIG. 8 demonstrates how the image transfer roller tends to move when rotated in contact with a photoconductive drum and how the roller moves when the cover is opened.

When the cover 201 is opened, the image transfer roller 10 tends to revolve around the axis of rotation of the cover 201, as indicated by a dashed arrow in FIG. 8. Therefore, the notch 70*a* and rod portion 104*d* mating with each other prevent the cover 201 from being opened. This makes an exclusive locking mechanism for the cover 201 needless.

The direction in which the image transfer roller 10 revolves at the beginning of opening of the cover 201 and the direction in which the roller 10 tends to move on contacting the drum 1 are coincident only when the cover 201 is held in the closed position. Therefore, the cover 201 does not open when subjected to a relatively weak force ascribable to the contact of the roller 10 with the drum 1 being rotated. However, the operator can easily open the cover 201 after slightly moving it away from the closed position with a relatively strong force.

The illustrative embodiment has concentrated on a printer including a first rotary body implemented as the drum 1. However, the present invention is, of course, applicable even to an image forming apparatus in which the first rotary body is implemented as, e.g., an intermediate image transfer drum.

In summary, it will be seen that the present invention provides an image forming apparatus having various unprecedented advantages, as enumerated below.

(1) When an openable cover is closed, the engaging portion of a first support member mounted on the apparatus body and that of a second support member mounted on the cover mate with each other. Therefore, even when the cover becomes unstable, a second rotary body is surely positioned relative to a first rotary body and maintained parallel to the first rotary body without resorting to a special measure against instability, which would increase the cost of the apparatus.

(2) Even when the second rotary body tends to move away from a preselected position due to drive transmitted via gears or contact with the first rotary body being rotated, the engaging portions of the first and second support members mating with each other prevent the second rotary body from moving. This is also successful to maintain the second rotary body parallel to the first rotary body.

(3) When the cover tends to open by accident, the engaging portions mating with each other prevent the second rotary body from starting moving together with the cover and thereby prevent the cover from opening. In this sense, the engaging portions constitute a locking mechanism and therefore obviate the need for an exclusive locking mechanism.

(4) When the cover is in its closed position, a photoconductive drum and an image transfer drum are maintained parallel to each other and ensure straight conveyance of a recording medium over a long period of time. Moreover, straight conveyance protects images from deformation ascribable to the skew of a recording medium.

Various modifications will become possible for those skilled in the art after receiving the teachings of the present disclosure without departing from the scope thereof.

What is claimed is:

1. A recording medium conveying mechanism for an image forming apparatus, comprising:

first and second rotary bodies configured to rotate in contact with each other for conveying a recording medium to which a toner image is to be transferred, said first rotary body and said second rotary body being respectively mounted on an apparatus body of said image forming apparatus, said second rotary body being configured to move into or out of contact with said first rotary body in interlocked relation to closing or opening, respectively, of a cover which is mounted on said apparatus body;

a first support member rotatably supporting said first rotary body on said apparatus body and including a first engaging portion integrally formed with the first support member; and a second support member rotatably supporting said second rotary body on said cover and including a second engaging portion integrally formed with the second support member, said first engaging portion and said second engaging portion being directly engaged with each other to position said first and second rotary bodies when said cover is closed.

2. The mechanism as claimed in claim 1, wherein said first rotary body comprises a photoconductive drum, which is an image carrier on which the toner image is to be formed, and said second rotary body comprises an image transfer roller for transferring said toner image from said photoconductive drum to the recording medium.

3. An image forming apparatus comprising:

an apparatus body;

first and second rotary bodies configured to rotate in contact with each other for conveying a recording medium to which a toner image is to be transferred, said first rotary body and said second rotary body being respectively mounted on an apparatus body of said image forming apparatus;

an openable cover mounted on said apparatus body, said second rotary body being configured to move into or out of contact with said first rotary body in interlocked relation to closing or opening, respectively, of said cover;

a first support member rotatably supporting said first rotary body on said apparatus body and including a first engaging portion integrally formed with the first support member; and a second support member rotatably supporting said second rotary body on said cover and including a second engaging portion integrally formed with the second support member, said first engaging portion and said second engaging portion being directly engaged with each other to position said first and second rotary bodies when said cover is closed; and toner image forming unit configured to form the toner image on said image carrier.

4. The apparatus as claimed in claim 3, wherein said first rotary body comprises a photoconductive drum, which is an image carrier on which the toner image is to be formed, and said second rotary body comprises an image transfer roller for transferring said toner image from said photoconductive drum to the recording medium.

5. A recording medium conveying mechanism for an image forming apparatus, comprising:

first and second rotary bodies configured to rotate in contact with each other at a contact portion for conveying in a conveying direction a recording medium to which a toner image is to be transferred, said contact portion being positioned at an upstream side in the conveying direction of the recording medium, said first rotary body and said second rotary body being respectively mounted on an apparatus body of said image forming apparatus, said second rotary body being configured to move into or out of contact with said first rotary body in interlocked relation to closing or opening, respectively, of a cover which is mounted on said apparatus body;

a first support member rotatably supporting said first rotary body on said apparatus body; and a second support member rotatably supporting said second rotary body on said cover.

* * * * *